US007391040B1

(12) United States Patent
Haynes et al.

(10) Patent No.: US 7,391,040 B1
(45) Date of Patent: Jun. 24, 2008

(54) THERMAL IMAGE BEACONS

(76) Inventors: Derek Haynes, 25080 Goldcrest Dr., Bonita Springs, FL (US) 34134; Stuart M. Jenkins, 105 Aldwick Road, Bognor Regis, West Sussex (GB) P021 2NY; Michael Thomas, 36 Seaview Avenue, Peacehaven, East Sussex (GB) BN 10 8SA ( * ) Notice: Subject to any disclaimer, the term of this patent is extended or adjusted under 35 U.S.C. 154(b) by 329 days.

(21) Appl. No.: 11/281,111

(22) Filed: Nov. 17, 2005

Related U.S. Application Data

(60) Provisional application No. 60/667,563, filed on Apr. 4, 2005.

(51) Int. Cl.
*G01J 1/00* (2006.01)

(52) U.S. Cl. ..... 250/495.1; 250/493.1; 250/494.1; 250/504 R; 250/503.1; 40/604; 40/606.1; 436/56

(58) Field of Classification Search ..... 250/504 R, 250/493.1, 495.1, 494.1, 503.1; 340/983; 40/604, 606.1; 436/56
See application file for complete search history.

(56) References Cited

U.S. PATENT DOCUMENTS 4,260,160 A * 4/1981 Ejnell et al. ..... 273/348.1
4,620,104 A * 10/1986 Nordal et al. ..... 250/493.1
4,659,089 A * 4/1987 Rosa ..... 273/348.1
4,816,694 A * 3/1989 Kuppenheimer et al. 250/504 R
4,912,334 A * 3/1990 Anderson ..... 250/495.1
H000820 H * 9/1990 Smoot ..... 250/504 R
5,326,265 A * 7/1994 Prevou ..... 434/11
5,444,262 A * 8/1995 Campagnuolo et al. .. 250/495.1
5,784,196 A * 7/1998 Sola ..... 359/529
6,069,557 A * 5/2000 Anglin et al. ..... 340/321
6,536,921 B1 * 3/2003 Simon ..... 362/277
6,768,126 B2 * 7/2004 Novak et al. ..... 250/504 R
7,158,020 B2 * 1/2007 Grady, Jr. ..... 340/473
2005/0084975 A1 * 4/2005 Armentrout et al. ..... 436/56

* cited by examiner

*Primary Examiner*—Jack I. Berman
*Assistant Examiner*—Michael J Logie
(74) *Attorney, Agent, or Firm*—John P. McGonagle

(57) ABSTRACT

A heat emitting beacon having a rotating parabolic mirror to concentrate the heat from a gas heat source, said mirror back being coated with a passive cold emission material comprised of a metalized plastic film creased and crumpled to form a multitude of reflective facets and preventing any reflected light. In a second embodiment, a rotating, single- or double-sided surface is coated with the passive cold emission material. In another embodiment, a signal beacon is comprised of a plurality of detachable strips of the passive cold emission material. In another embodiment, a plurality of surface elements covered with the passive cold emission material is arranged as a louver.

9 Claims, 4 Drawing Sheets

THERMAL IMAGE BEACONS

CROSS-REFERENCE TO RELATED APPLICATIONS

Applicants claim the priority benefits of U.S. Provisional Patent Application No. 60/667,563, filed Apr. 4, 2005.

BACKGROUND OF THE INVENTION

This invention relates to thermal identification, and more particularly, to a thermal image identification marker utilizing infrared (IR) energy from 1000-1400 nanometers.

The inability of reconnaissance to determine friend or foe in low light or total darkness is a major failing in battlefield and law enforcement operations. The worst effect is that fratricide (the inadvertent killing of friendly forces by other friendly forces) occurs, and at best is a waste of time and resources attempting to confirm identification. Accurate intelligence allows deployment effort to be maximized and focused.

Present marking and identification systems are limited to either Near IR range (1010 nano meters or less) beacons for use with night vision glasses or thermal panel identification marking equipment. Present thermal panel identification marking equipment is passive and provides identification by temperature or emissivity differences between adjacent areas and the marking equipment. Passive marking equipment is easily masked by surrounding operations, and is difficult to differentiate from adjacent targets.

There is a requirement for thermal (heat emitting) devices for military and law enforcement purposes to enable specific identification of distant objects, people, vehicles or positions by means of ground or air mounted thermal imaging cameras in spite of ambient thermal noise. Anti-fratricide protection is one very important application for such devices.

The present invention relates to beacons, and more particularly to a beacon for use as a marker and identifier in conjunction with night vision applications and situations.

However, in the areas of law enforcement and military applications there is a need to provide marker and identification beacons which operate in the wavelength band of 1 to 13 microns to clearly identify friend from foe, this being achieved without anything being seen by the naked eye.

Thermal imaging cameras have now reached a high state of development and produce clear images with clear contrast and magnification across a wide thermal gradient range of temperatures between hot and cold surfaces.

There are two approaches to thermal beacons, active and passive. The active approach uses a tripod with a controlling motor and either an electrically driven head or a gas driven head. The electrically powered head would be used in situations where sufficient power is available to drive the active emission part of the beacon, such as a main power feed or a vehicle battery. The gas driven head would be used in stand alone situations where power is not readily available. In either case, the active element can be rotated causing the unit to appear to flash to an observer with a thermal detection device.

The passive approach uses material which is thermally reflective. Passive technology requires a significant size panel when deployed to provide a surface detectable from 3,000 meters. However, the reflecting panel must be compact for transportation and deployment. To meet these conflicting requirements, it is necessary to construct a folding system which allows the reflection panel to be collapsed and has holes, slits or slots to accommodate wind and prop and helo wash.

In prior applications, applicants have described various forms of beacons which produce a flashing heat output. There is a limitation in these beacons in that they need considerable power in order to operate effectively. From an operational point of view, the power requirement can make them undesirable for certain applications.

SUMMARY OF THE INVENTION

The present invention provides a means for reducing the power requirements of prior art beacons and providing an enhanced contrast for the beacons.

The night-time sky is a passive, cold, black body, which, when viewed through a thermal imaging camera, looks ink black because of its very low level of heat emission. This may be termed passive cold emission. It is known that passive cold emission can be "reflected" by means of a reflective surface which is suitably coated to prevent or minimize any reflected light.

The present invention uses this property to improve the contrast with a heat emitting beacon and thereby create a low cost flashing beacon which transmits an intermittent, very clear and noticeable black image to a thermal imaging camera, which image cannot be seen by the naked eye.

Applicants have developed a heat emitting beacon which embodies a rotating parabolic mirror to concentrate the heat from a liquid propane gas heat source. This beacon operates most effectively, clearly being visible through a thermal imaging camera. However, applicants have found that the effectiveness of this mirror can be greatly enhanced by coating the back of the parabolic mirror with a passive cold emission coating. This results in the bright white heat flash from the front of the parabolic mirror being vividly contrasted with the ink black cold passive reflection of the passive cold emission coating on the back of the parabolic mirror as the mirror is rotated. The passive reflective material can consist of metalized plastic film. Applicants have found that the efficiency of the passive reflective material will be enhanced if it is creased and crumpled to form a multitude of reflective facets.

In a second embodiment of the present invention, a rotating, double-sided surface, which only reflects the passive cold ink black image, creates an effective beacon, thereby producing a very visible, double, black flash as seen through a thermal imaging camera. The advantage of this embodiment is that it can be made very cheaply and is greatly portable with the need only for a small battery to power the rotating head. The head can be either single or double sided.

In a further embodiment of this invention, a signal beacon can be created which utilizes detachable strips of the passive reflective material. This can be arranged and fixed by means of a Velcro attachment or similar means to a neutral surface to form a recognizable symbol to identify a particular position, which can only be seen through a thermal imaging camera.

In a further embodiment of this invention, a plurality of surface elements can be arranged, very much like a Venetian blind, each of which is coated with a passive cold black surface. This surface can be seen at a distance by a thermal imaging camera as a combined black image, which can be made to flash, as each element is rotated through an angle. This arrangement has also the advantage of being unidirectional. In addition, it has the further advantage of being able to be expanded and collapsed into a relatively small volume container for transportation purposes, without the need for an outside power source.

These together with other objects of the invention, along with various features of novelty which characterize the invention, are pointed out with particularity in the claims annexed hereto and forming a part of this disclosure. For a better understanding of the invention, its operating advantages and the specific objects attained by its uses, reference should be had to the accompanying drawings and descriptive matter in which there is illustrated a preferred embodiment of the invention.

DETAILED DESCRIPTION OF THE INVENTION

Figure 1B:
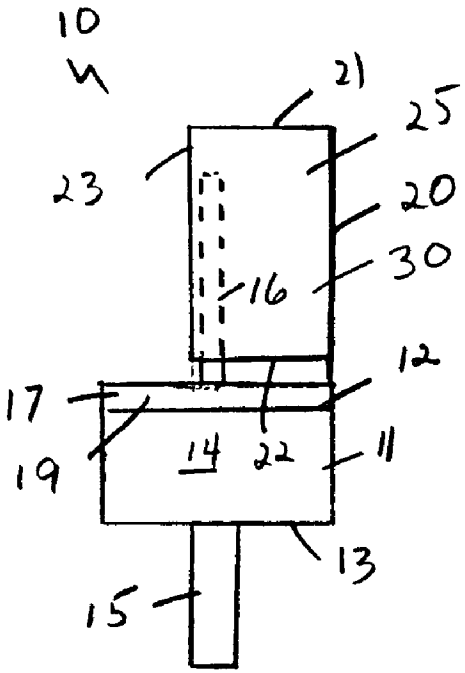
FIG. 1B is a side view thereof.

Referring to the drawings in detail wherein like elements are indicated by like numerals, there are shown four embodiments of the invention. The beacons described can only be seen through a thermal imaging camera or similar device. The reflecting cold black surfaces, i.e., coated with passive cold emission material, need not necessarily rotate, but perception will be much greater if the reflecting passive cold surface does rotate to produce a passive cold black flash.

Figure 1A:
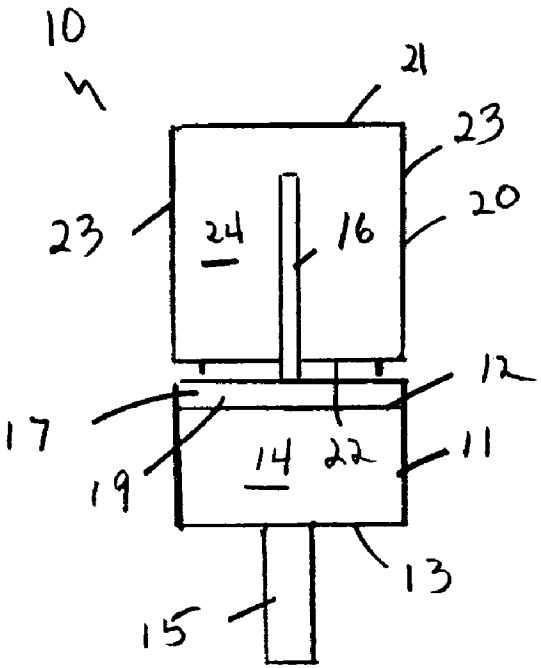
FIG. 1A is a front view of a rotating heat emitting beacon with a passive cold black reflecting surface attached to the rear of the parabolic mirror.
Figure 1C:
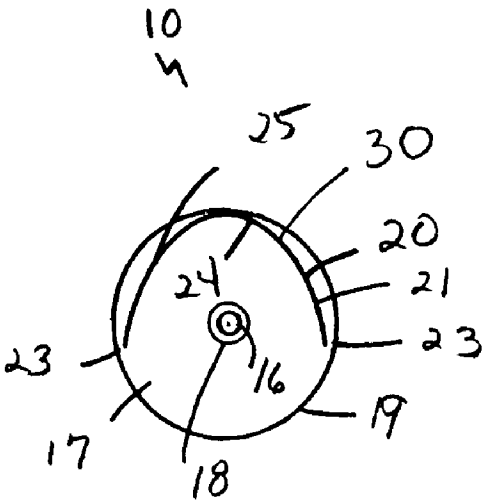
FIG. 1C is a top view thereof.

Referring more particularly to FIGS. 1A-1C, there is shown a rotating heat emitting beacon 10 with a passive cold black reflective surface 30 attached to the rear 25 of a parabolic mirror 20. The mirror 20 could have a parabolic shape in one, two and/or three planes. The beacon 10 has a motor drive assembly 11 with a top 12, bottom 13, and a circumferential side wall 14 extending from bottom 13 to top 12. Extending centrally out of the motor drive assembly bottom 13 is an extension 15 which can be a handhold, a device to fit a tripod stand, a device to attach to a ground stake or a suitable place on a vehicle. A stationary heat emitter 16 extends centrally out of the motor drive assembly top 12. The motor drive assembly 11 has a rotating head 17 attached to its top 12, said rotating head having a central aperture 18 through which said heat emitter projects from said motor drive assembly top 12. The parabolic mirror 20 has a top 21, a bottom 22, and two sides 23. The mirror 20 is concavo-convex, i.e., having a front concave surface 24 facing the heat emitter 16 and an opposite rear convex surface 25. The mirror bottom 22 is attached to the rotating head 17 adjacent a rotating head circumferential perimeter 19 and is adapted in conjunction with the rotating head 17 to perform a 360 degree rotation about the stationary heat emitter 16. The mirror sides 23 project radially just past the heat emitter 16. The passive cold black reflecting surface 30 is attached to the mirror rear convex surface 25.

The reflection surface for either a passive or active beacon must generally rotate to cause a flashing image as seen by the thermal sensing device. To meet this requirement, the reflective head is constructed of fabric or plastic film covered with cold black reflection material. This enables the material to be folded for transportation and stretched over a frame to provide a flat or curved reflective surface. Alternatively, the reflective surfaces are contained or located on surfaces which can be tilted like Aldus lamp shutters.

Figure 2C:
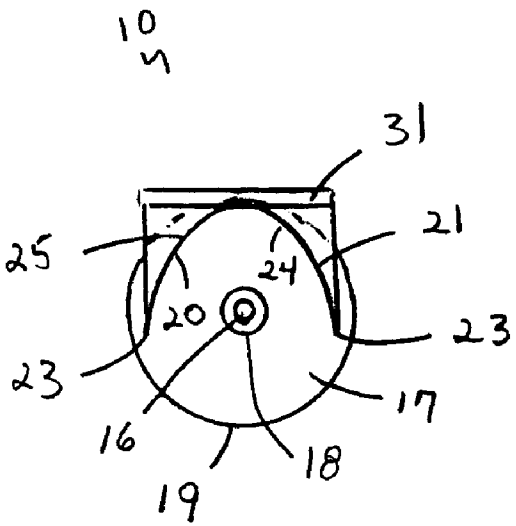
FIG. 2C is a top view thereof.
Figure 2B:
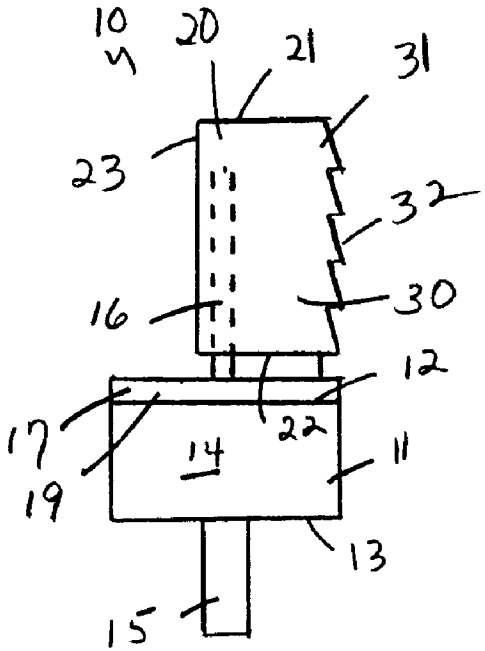
FIG. 2B is a side view thereof.
Figure 2A:
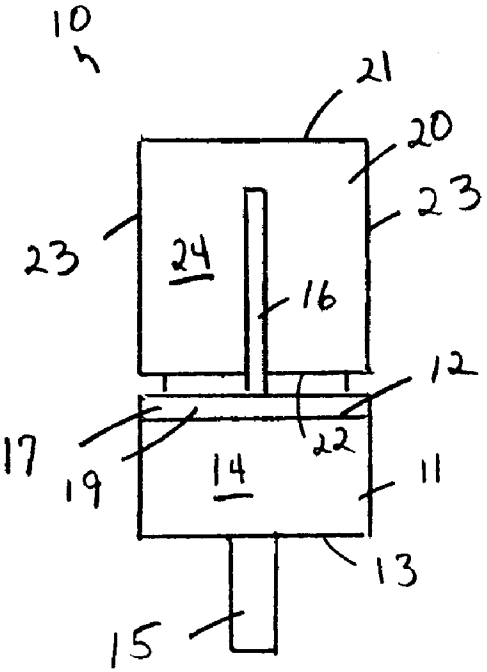
FIG. 2A is a front view of a rotating heat emitting beacon with a double-sided passive cold black reflecting surface attached to the rotating head.

Referring more particularly to FIGS. 2A-2C, there is shown a double-sided passive cold black reflecting surface 30 attached to the mirror 20. The passive cold black reflecting surface 30 has a saw tooth configuration 31 providing a plurality of facets 32 at an optimum angle relative to the cold black sky, thereby enabling the diameter of the beacon to be minimized.

Figure 3C:
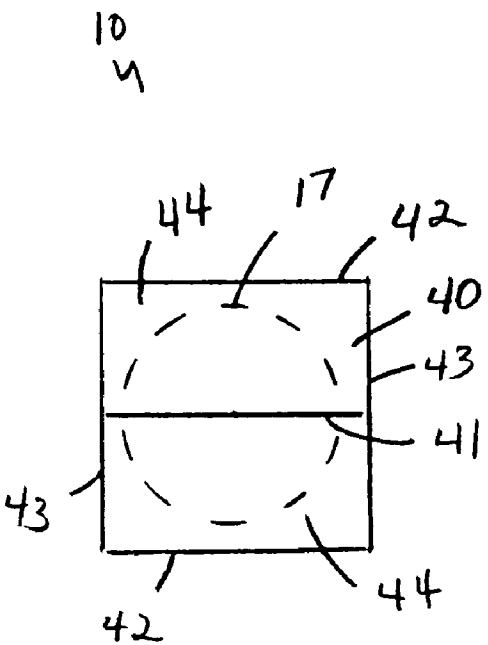
FIG. 3C is a top view thereof.
Figure 3B:
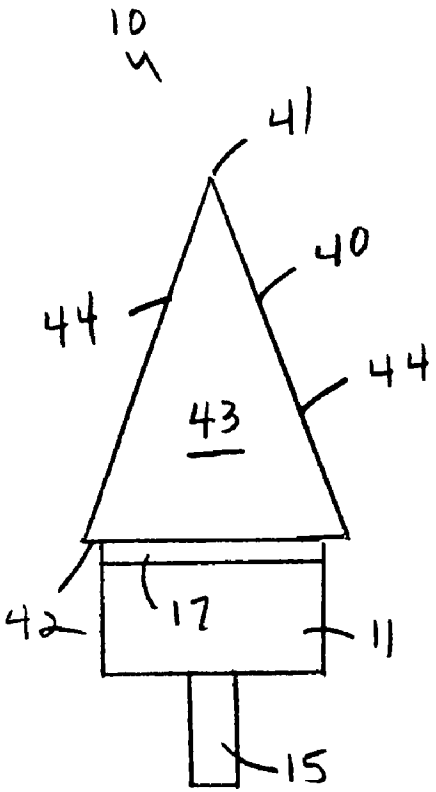
FIG. 3B is a side view thereof.
Figure 3A:
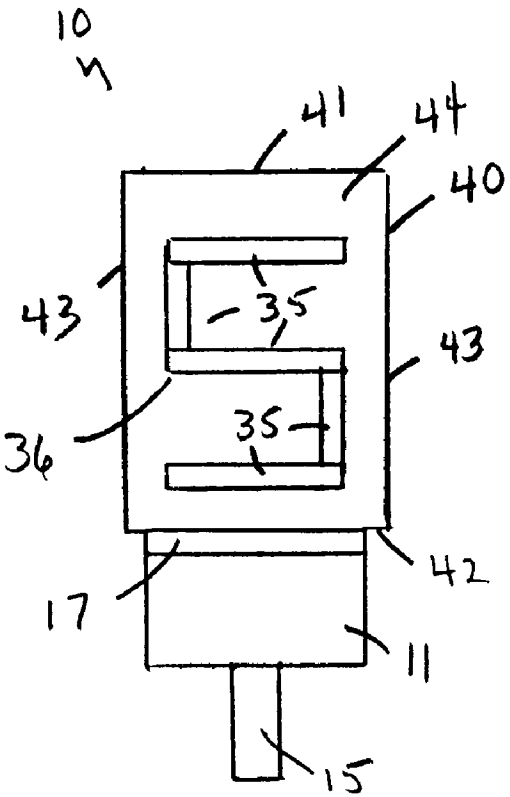
FIG. 3A is a front view of a rotating heat emitting beacon with a series of cold black reflecting surfaces to create a recognizable pattern.

Referring more particularly to FIGS. 3A-3C, the mirror 20 is replaced with a pyramidal frame 40 having a narrow top 41, a broad bottom 42, two opposite sides 43 and two opposite, flat surfaces 44. The bottom 42 is attached to the rotating head 17. A plurality of passive cold reflective strips 35 are attached to one or both surfaces 44 and arranged as a recognizable symbol 36, e.g., 5. The surfaces 44 are made out of a contrasting material. The strips 35 can be rearranged to obtain any desired number or symbol which will be seen only by means of a thermal imaging camera. In an alternative embodiment, the surfaces 44 could be made of a passive cold reflective material, and the strips 35 made of a contrasting material. The strips 35 may be removably attached by means of hook and pile fasteners sold under the trademark, VELCRO, or by other means.

Figure 4B:
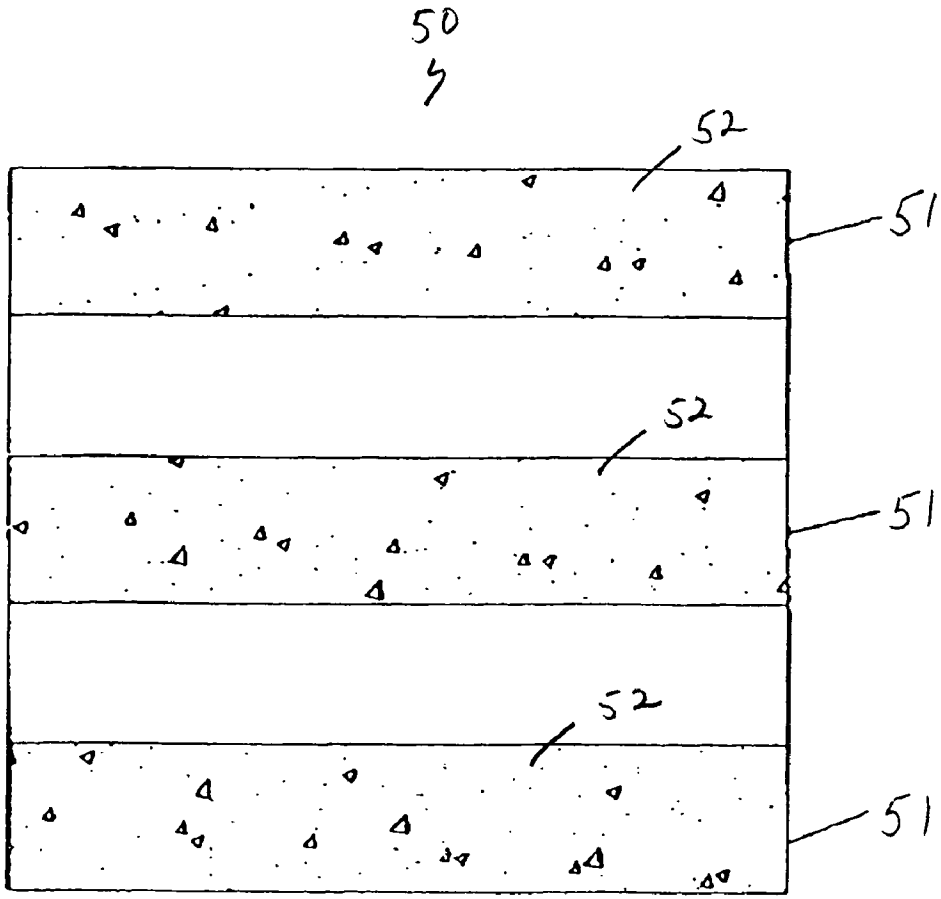
FIG. 4B is a front view thereof.
Figure 4A:
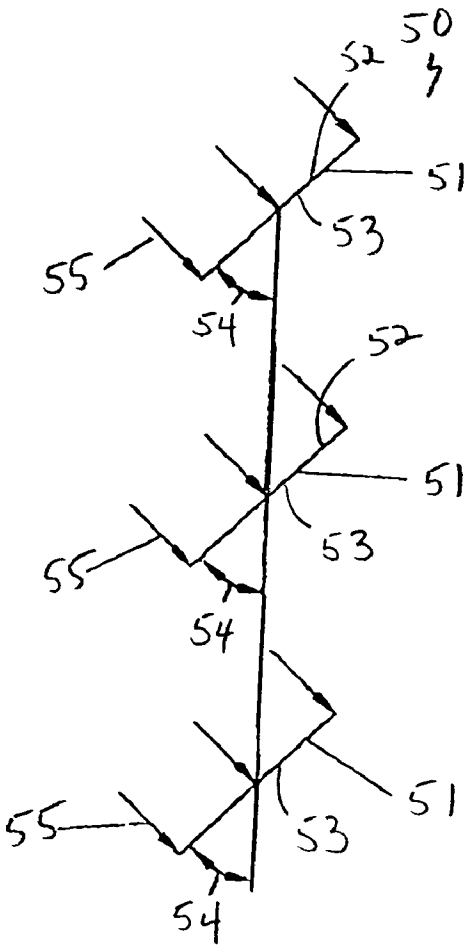
FIG. 4A is a side view of a beacon with a plurality of surface elements in a louver arrangement, said surface elements being coated with a passive cold black material.

Referring more particularly to FIGS. 4A-4B, there is shown a beacon having a plurality of flat elements 51, each element having a front surface 52 which has a passive cold coating and a rear surface 53, said elements being arranged in a louver configuration 50. The flat elements 51 can be rotated from a vertical position to a horizontal position by a suitable oscillating mechanism through an angle 54. In this way, the combined area of the elements 51 produces a cold black flash at a distance when viewed by a thermal imaging camera as seen in direction 55 only. The entire arrangement 50 may also be rotated through 360 degree about its vertical axis.

It is understood that the above-described embodiment is merely illustrative of the application. Other embodiments may be readily devised by those skilled in the art which will embody the principles of the invention and fall within the spirit and scope thereof. For example, the passive and active beacon approaches can be combined.

We claim:

1. An infrared thermal image beacon for use as a marker and identifier in conjunction with night vision and thermal identification marking equipment, comprising:

a motor drive assembly having a top, bottom, and a circumferential side wall extending from bottom to top;

a rotating head attached to the motor drive top;

a mirror attached to said rotating head, said mirror having a front surface, a rear surface, a top, a bottom, and two-sides;

a passive cold black reflective surface attached to the mirror rear surface;

an extension extending centrally out of the motor drive assembly bottom;

wherein said passive cold black reflective surface is creased and crumpled forming a plurality of reflective facets.

2. A thermal image beacon as recited in claim 1, further comprising:

a central aperture in said rotating head;

a stationary heat emitter extending centrally out of the motor drive assembly top through said rotating head central aperture;

wherein the mirror has a parabolic shape in a plurality of planes, said mirror having a front concave surface facing the heat emitter and an opposite rear convex surface, said mirror bottom being attached to the rotating head adjacent a rotating head circumferential perimeter, said mirror adapted in conjunction with the rotating head to perform a 360 degree rotation about the stationary heat emitter, said mirror sides projecting radially past the heat emitter, said passive cold black reflective surface being attached to the mirror rear convex surface.

3. A thermal image beacon as recited in claim 2, wherein:

the passive cold black reflective surface attached to the mirror rear surface has a saw tooth configuration providing a plurality of facets.

4. A thermal image beacon as recited in claim 3, wherein:

said passive cold black reflective surface is comprised of a metalized plastic film.

5. An infrared thermal image beacon for use as a marker and identifier in conjunction with night vision and thermal identification marking equipment, comprising:

a plurality of flat elements, each element having a front surface which has a passive cold black reflective surface and a rear surface, said elements being arranged in a louver configuration;

an oscillating mechanism attached to said plurality of flat elements, said oscillating mechanism adapted to rotate said flat elements from a vertical position to a horizontal Position;

a motor drive assembly having a top, bottom, and a circumferential side wall extending from bottom to top;

a rotating head attached to the motor drive top;

an extension extending centrally out of the motor drive assembly bottom;

wherein said louver configuration is attached to said rotating head;

wherein each said passive cold black reflective surface is creased and crumpled forming a plurality of reflective facets.

6. A thermal image beacon as recited in claim 5, wherein:

said passive cold black reflective surface is comprised of a metalized plastic film.

7. An infrared thermal image beacon for use as a marker and identifier in conjunction with night vision and thermal identification marking equipment, comprising:

a plurality of flat elements, each element having a front surface which has a passive cold black reflective surface and a rear surface, said elements being arranged in a louver configuration;

an oscillating mechanism attached to said plurality of flat elements, said oscillating mechanism adapted to rotate said flat elements from a vertical position to a horizontal Position;

wherein each said passive cold black reflective surface is creased and crumpled forming a plurality of reflective facets.

8. A thermal image beacon as recited in claim 7, wherein:

said passive cold black reflective surface is comprised of a metalized plastic film.

9. An infrared thermal image beacon for use as a marker and identifier in conjunction with night vision and thermal identification marking equipment, comprising:

a motor drive assembly having a top, bottom, and a circumferential side wall extending from bottom to top;

a rotating head attached to the motor drive top;

a pyramidal frame having a narrow top, a broad bottom, two opposite sides and two opposite, passive cold black reflective surfaces, said pyramidal bottom being attached to the rotating head;

a plurality of strips removable attached to said passive cold black reflective surfaces, said strips being comprised of a contrasting material and arranged as a recognizable symbol;

an extension extending centrally out of the motor drive assembly bottom;

wherein each said passive cold black reflective surface is creased and crumpled forming a plurality of reflective facets.

* * * * *